United States Patent [19]

Dzodin

[11] Patent Number: 4,840,717

[45] Date of Patent: Jun. 20, 1989

[54] SILVER RECOVERY CELL

[76] Inventor: Milton A. Dzodin, 29733 Red Leaf Dr., Southfield, Mich. 48076

[21] Appl. No.: 235,676

[22] Filed: Aug. 24, 1988

[51] Int. Cl.[4] ..... C25C 1/20; C25C 7/06

[52] U.S. Cl. ..... 204/237; 204/270; 204/272; 204/273; 204/275; 204/278; 204/292; 204/294

[58] Field of Search ..... 204/109, 270–273, 204/275, 278, 269, 292, 294, 237

[56] References Cited

U.S. PATENT DOCUMENTS

| | | | |
|---|---|---|---|
| 2,997,438 | 8/1961 | James et al. | 204/271 |
| 3,458,425 | 7/1969 | Tolle et al. | 204/109 |
| 3,477,926 | 11/1969 | Snow et al. | 204/109 |
| 3,524,805 | 8/1970 | Engelman | 204/109 X |
| 4,039,407 | 8/1977 | Kelleher | 204/109 |
| 4,372,829 | 2/1983 | Cox | 204/272 X |
| 4,612,102 | 9/1986 | Brimo et al. | 204/272 X |
| 4,675,085 | 6/1987 | Vasquez | 204/272 X |

*Primary Examiner*—Donald R. Valentine

*Attorney, Agent, or Firm*—Peter D. Keefe

[57] ABSTRACT

A silver recovery cell for devices recovering silver from silver laden solutions, the silver recovery cell permitting visual inspection of the condition of plated silver within the cell. A clear canister is provided having an anode rod centrally connected thereto at its bottom. A cathode cylinder coaxially surrounds the anode rod; the cathode cylinder has a longitudinal slot. Terminals through the clear canister are provided for both the anode rod and the cathode cylinder in order to connect a conventional electrical power supply therewith. A removable top is further provided having inlet and outlet passageways for the silver laden solution to enter the leave the clear canister. An inlet port constrictor is provided to speed up fluid flow of the silver laden solution into the clear canister. In operation, a user may view the status of silver plating by merely looking through the clear canister and the slot in the cathode cylinder. A light may be provided in the top to facilitate visual inspections.

21 Claims, 1 Drawing Sheet

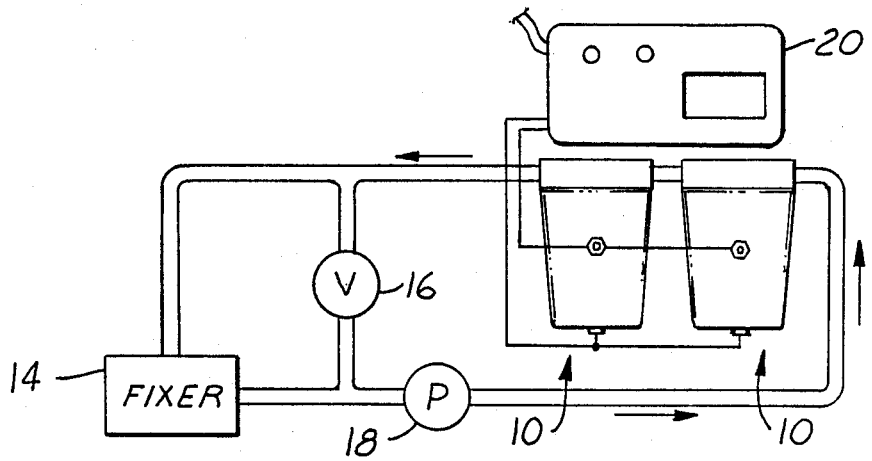
FIG.1
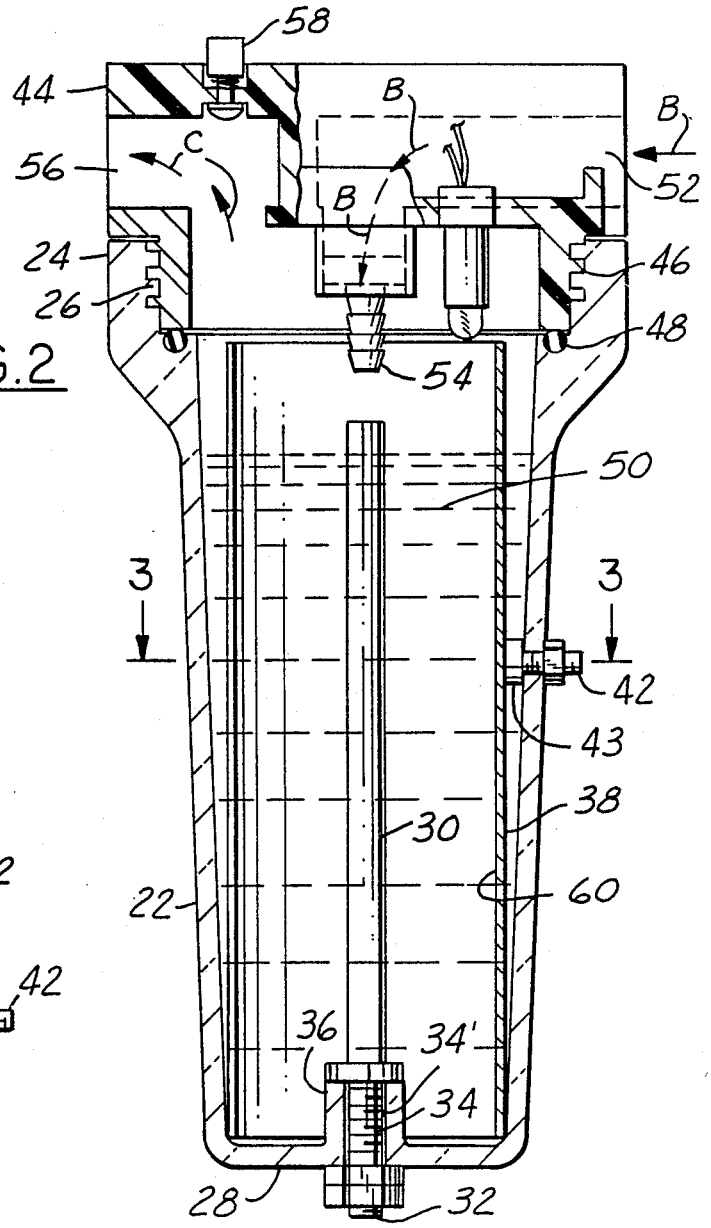
FIG.2
FIG.3
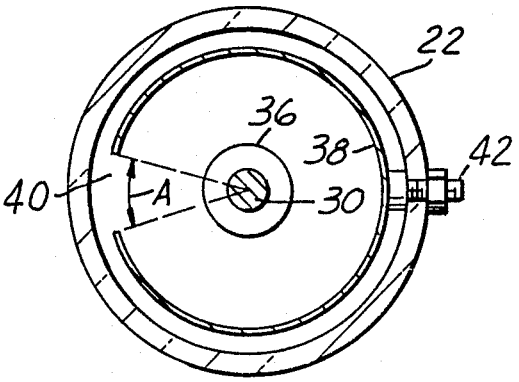

SILVER RECOVERY CELL

BACKGROUND OF THE INVENTION

1. Field of the Invention

The present invention pertains to silver recovery devices for silver laden solutions; more particularly to a silver recovery device used to recover silver obtained during photographic processes; and still more particularly to an improved silver recovery cell therefor.

2. Description of the Prior Art

It is well known that silver based compounds are a major constituent of photographic film. After the film has been exposed to light, it is subjected to a "developer" solution. The light exposure combined with a bath in the developer solution results in some of the silver in the silver compounds being converted to metallic silver, resulting in an image of the film. In order to prevent any remaining silver compounds from being affected by further exposure to light, the film is chemically processed by a "fixer" solution to remove the remaining silver compounds that were not affected by the aforesaid light exposure. This "fixes" the film and allows it to be subsequently viewed in lighted environments without the image thereon being affected. This developing process of photographic film is very well known in the art and results in large amounts of silver being released into the fixer solution. For both environmental and economic reasons, it is very desirable to recover as much of this released silver as is possible.

It is known in the prior art to recover silver from photographic solutions by use of an electrical silver plating system. An example of such a system is described in U.S. Pat. No. 3,875,032 to Thompson, where a power supply is electrically connected to an anode and cathode, each being immersed in a photographic fixer solution. When electricity is applied to the electrodes, silver, present in the solution as either suspended metallic silver or as suspended or dissolved silver compounds, is caused to plate on the cathode. In Thompson, the photographic fixer solution is contained in a tank rendering the process awkward and inefficient.

An improved type of electrical silver plating system is described in U.S. Pat. No. 4,612,102 to Brimo et al. Brimo et al teach that the silver plating process may be performed utilizing a cell having a cylindrically shaped canister for containing the photographic fixer solution. Brimo et al teach that a rod shaped anode of graphite material is connected to a removable top and that a cylindrically shaped cathode having a longitudinal slit encircles the anode and is resident in the canister. Terminals connect a power supply to the cathode and the anode. While this cell is an improvement over the tank of Thompson, it suffers from inability to visually inspect the status of the silver plating that is occurring on the cathode, a factor that is critical in controlling quality of the operation. Further, because the anode is connected to the top, silver tends to plate mainly adjacent to the top, where the fixer solution is entering the canister, rather than along the entire longitudinal length of the cathode, resulting in inefficient operation.

Accordingly, what is needed is a silver recovery device which incorporates a cell having the structural features of visual inspection of silver plating at the cathode and uniform plating of the cathode surface.

SUMMARY OF THE INVENTION

The present invention is a silver recovery device incorporating a recovery cell structured to permit visual inspection of the status of silver plating on the cathode and to ensure uniform silver plating on the surface of the cathode.

A clear cylindrical canister is provided having a closed bottom and an open top. A graphite, rod is secured to the bottom at the axial center of the clear canister, and a terminal is provided to connect the graphite rod to a power supply. The graphite rod serves as the anode. A cylindrically shaped cathode of stainless steel is provided which inserts into the clear canister and surrounds the anode. A longitudinal slit subtending an angel of approximately 60 degrees is provided in the cathode. A terminal in the side of the clear canister connects the cathode to the power supply. A removable top is provided through which fixer solution enters and leaves the clear canister. It is preferred that the fixer solution enter the canister in a manner so as to cause general agitation of the fixer solution in the clear canister. In operation, the condition of silver plating can be ascertained by looking through the clear canister and the slit in the cathode. A light may be provided in the removable top to facilitate seeing the plated silver on the cathode.

It is, therefore, an object of the present invention to provide a silver recovery device for silver laden solutions having a recovery cell that permits visual inspection of the plated silver on the cathode.

It is an additional object of the present invention to provide a silver recovery cell of the aforesaid type having a predetermined relationship between the cathode and anode and the silver laden solution entry and exit ports so as to cause silver to be uniformly plated on the cathode.

It is a further object of the present invention to provide a silver recovery device having improved silver laden solution flow characteristics. These, and additional objects, advantages, features and benefits of the invention will become apparent from the following specification.

BRIEF DESCRIPTION OF THE DRAWINGS

FIG. 1. is a schematic view of the preferred environment of use of the present invention.

FIG. 2. is a part sectional side view of the recovery cell according to the present invention.

FIG. 3 is a plan view of the recovery cell according to the present invention, shown along lines 3—3 of FIG. 2.

DETAILED DESCRIPTION OF THE PREFERRED EMBODIMENT

Referring now to the figures, FIG. 1 shows the present invention in its preferred environment of use. Two identical recovery cells 10 are connected in series through appropriate piping 12 to a photographic fixer solution bath 14. The piping includes a conventional valve 16 for selectively directing the flow of photographic fixer solution so as to either flow through the recovery cells 10 or to by-pass them. A conventional pump 18 is included to enhance flow of photographic fixer solution when the valve 16 is adjusted to cause flow through the recovery cells 10. A conventional power supply 20 provides electrical power to the recovery cells 10 in a manner to be discussed hereinbelow. In this preferred environment of use, the recovery cells 10 according to the present invention selectively remove silver from the photographic fixer solution.

Referring now to FIGS. 2 and 3, the structure and operation of the recovery cell 10 according to the present invention may be understood.

A clear canister 22 of cylindrical shape is provided. The top 24 of the clear canister 22 is open and provided with threads 26. A preferred material for the clear canister 22 is a clear plastic or glass. The bottom 28 of the clear canister is closed. Attached to the bottom 28 at the axial center of the clear canister, an anode rod 30 is provided. The anode rod projects upwardly into the clear canister 22 along its axial center. An anode terminal 32 is connected to the end of the anode rod. Threads 34 and 34' are provided, respectively, on the bottom 28 and the anode terminal 32 to secure the anode rod to the clear canister. Alternatively, the anode rod may be secured to the clear canister by an adhesive being applied to the bottom 28 and the anode terminal 32. The anode rod 30 is preferred to be constructed of graphite. It is further preferred that there be a cylindrically shaped mounting portion 36 in the bottom 28 so that the anode rod will be rigidly secured to the bottom 28 by engagement therewith. A cathode cylinder 38 is provided in the clear canister 22. The cathode cylinder is preferred to be structured to have a diameter substantially similar to that of the inside diameter of the clear canister. Further, the cathode cylinder 38 is provided with a longitudinal slot 40, the slot preferably subtending an arc A of approximately 60 degrees. The cathode cylinder surrounds the anode rod 30 along the entire length of the anode rod. A cathode terminal 42 is provided through the side of the clear canister 22. The cathode terminal terminates interior of the clear canister in a contact 43 which touches against the cathode cylinder 38 so as to provide good electrical connection between the cathode cylinder 38 and the cathode terminal 42. It is preferred that the cathode cylinder be constructed of stainless steel.

The top 44 is structured to releasably thread onto the clear canister 22, via threads 46. A resilient gasket 48 seals the top 44 with respect to the clear canister 22. The top 44 includes passageways for the photographic fixer solution 50 to flow into and out of the clear canister 22. An inlet passageway 52 is provided which connects with the piping 12. Photographic fixer solution flows through the top 44 as indicated by arrows B. The photographic fixer solution 50 flows into an inlet port 54 before entering the clear canister 22. The inlet port 54 is structured to cause constriction of the fluid flow therethrough so as to cause a fluid flow velocity increase when the photographic fixer solution leaves the inlet port 54 and enters the clear canister. The fluid flow velocity is preferred to be such as to cause a general agitation and mixing of the photographic fixer solution in the clear canister so that a maximum opportunity is provided for the photographic fixer solution to swirl along the entire length of the anode rod 30. The top 44 further includes an exit passageway 56 through which photographic fix solution 48 may exit, along arrows C, from the clear canister 22 and return to the piping 12. A spring loaded air bleed 58 is provided at the uppermost part of the exit passageway 56 so that air may be selectively bled out of the recovery cell 10. By allowing air to bleed during filling of the silver recovery cell 10, filling time is considerably reduced as compared to a system not incorporating an air bleed 58.

In operation, the anode terminal and the cathode terminal are connected to a suitable conventional power supply. Such a power supply is described, for example, in the aforesaid U.S. Pat. Nos. 3,875,032 and 4,612,102; it is to be understood that a suitable conventional power supply is not intended to be limited to the types described in the aforesaid patents. When electrical power is supplied to the anode and cathode terminals and there is a silver laden photographic fixer solution present within the clear canister, silver will be caused to plate onto the cathode cylinder. The status of this plating may be observed at any time by looking through both the clear canister and the slot in the cathode cylinder. When it is determined by such inspection that either plating is not occurring as expected or that a maximum acceptable amount of plating has occurred, steps may thereupon be taken to ensure continued maximum efficiency of the recovery cell 10. Because the anode rod is secured in the recovery cell 10 remote from the top where photographic fixer solution enters the clear canister, there is general uniformity of plating of silver over the inside surface 60 of the cathode cylinder 38.

To facilitate inspection of the plated silver on the interior surface 60 of the cathode cylinder 22, a light 52 may be provided in the top 44 at a location adjacent the inlet port 54. The light 52 is illuminated by electricity supplied into the top and a switch (not shown) is used to selectively actuate the light when viewing into the clear canister.

To facilitate silver removal, recovery cells 10 may be connected serially, as shown in FIG. 1, where the exit pasageway of one connects to the inlet passageway of the next.

To facilitate fluid flow of the photographic fixer solution through the recover cell 10, a pump 18 is attached to the piping 12. This is especially advantageous when a recovery cell 10 is connected in series with one of more recovery cells 10, as shown in FIG. 1.

To those skilled in the art to which this invention appertains, the above described preferred embodiment may be subject to change or modification. Such changes or modifications can be carried out without departing from the scope of the invention, which is intended to be limited only by the scope of the appended claims.

What I claim is:

1. A silver recovery cell for a silver recovery system, said silver recovery system being used for recovering silver from a silver laden solution, said silver recovery cell comprising:

a clear canister, said clear canister having a closed bottom and an open end;

an anode rod attached to said closed bottom of said clear canister, said anode rod projecting upwardly in said clear canister;

an anode terminal electrically connected to said anode rod;

a cathode cylinder in said clear canister, said cathode cylinder encircling with touching said anode rod, said cathode cylinder having a longitudinal slot;

a cathode terminal electrically connected to said cathode cylinder;

a top releasably attached to said clear canister at said open end;

inlet means for introducing said silver laden solution into said clear canister;

out means for exiting said silver laden solution from said clear canister;

means for fluidically sealing said top with respect to said clear canister; and air bleed means for selectively bleeding air from said silver recover cell, said air bleed means being connected with said top.

2. The silver recovery cell of claim 1, further comprising an inlet port in fluidic communication with said inlet means, said inlet port being located in axial alignment with said anode rod, said inlet port causing flow of said silver laden solution to be sped up upon passage therethrough.

3. The silver recovery cell of claim 2, further comprising a light connected to said top for illuminating said clear canister between said anode rod and said cathode cylinder.

4. The silver recovery cell of claim 3, wherein said clear canister has an interior diameter; wherein further said anode rod is attached to said bottom at its geometrical center, side anode rod further being oriented axially relative to said clear canister; and further wherein said cathode cylinder has a diameter substantially equal to that of said interior diameter of said clear canister, said cathode cylinder extending coaxially with said anode rod.

5. The silver recovery cell of claim 4, wherein said clear canister is constructed of a clear plastic, said anode terminal is constructed of graphite, and said cathode cylinder is made of stainless steel.

6. The silver recovery cell of claim 5 wherein said silver laden solution is a photographic fixer solution.

7. A silver recovery cell for a silver recovery system, said silver recovery system being used for recovering silver from a silver laden solution, said silver recovery cell comprising:

a clear canister, said clear canister having a closed bottom and an open end;

an anode rod attached to said bottom of said clear canister, said anode rod projecting upwardly into said clear canister;

an anode terminal electrically connected to said anode rod;

a cathode cylinder in said clear canister, said cathode cylinder encircling without touching said anode rod, said cathode cylinder having a longitudinal slot;

a cathode terminal electrically connected to said cathode cylinder;

a top releasably attached to said clear canister at said open end, said top having an inlet passageway for said silver laden solution, said top further having an exit passageway for said silver laden solution;

means for fluidically sealing said top with respect to said clear canister;

air bleed means for selectively bleeding air from said silver recovery cell, said air bleed means being connected with said top;

an inlet port in fluidic communication with said inlet passageway in said top, said inlet port causing flow of said silver laden solution to be sped up upon passage therethrough; and a light connected to said top for illumination said clear canister between said anode rod and said cathode cylinder.

8. The silver recovery cell of claim 7, wherein said clear canister has an interior diameter; wherein further said anode rod is attached to said bottom at its geometrical center said anode rod further being oriented axially relative to said clear canister; and further wherein said cathode cylinder has a diameter substantially equal to that of said interior diameter of said clear canister, said cathode cylinder extending coaxially with said anode rod.

9. The silver recovery cell of claim 8, wherein said clear canister is constructed of a clear plastic, said anode terminal is constructed of graphite, and said cathode cylinder is made of stainless steel.

10. The silver recovery cell of claim 9, wherein said silver laden solution is a photographic fixer solution.

11. A silver recovery system, said silver recovery systems being used for recovering silver from a silver laden solution, said silver recovery system comprising:

at least one silver recovery cell, each said silver recovery cell comprising:

a clear canister, said clear canister having a closed bottom and an open end;

an anode rod attached to said closed bottom of said clear canister, said anode rod projecting upwardly into said clear canister;

an anode terminal electrically connected to said anode rod;

a cathode cylinder in said clear canister, said cathode cylinder encircling said anode rod, said cathode cylinder having a longitudinal slot;

a cathode terminal electrically connected to said cathode cylinder;

a top releasably attached to said clear canister at said open end;

inlet means for introducing said silver laden solution into said clear canister;

outlet means for exiting said silver laden solution from said clear canister;

means for fluidically sealing said top with respect to said clear canister; and air bleed means for selectively bleeding air from said silver recovery cell, said air bleed means being connected with said top;

electrical means for selectively supplying electricity to said anode terminal and said cathode terminal;

piping means for selectively piping said silver laden solution from a first location to said recovery cell and back to said first location; and pump means connected with said piping means for selectively pumping said silver laden solution from said first location to said inlet means of said recovery cell.

12. The silver recovery system of claim 11, wherein said at least one silver recovery cell further comprises an inlet port in fluidic communication with said inlet means, said inlet port being located in axial alignment with said anode rod, said inlet port causing flow of said silver laden solution to be sped up upon passage therethrough.

13. The silver recovery system of claim 12, wherein said at least one silver recovery cell further comprises a light connected to said top for illuminating said clear canister between said anode rod and said cathode cylinder.

14. The silver recovery system of claim 13, wherein said clear canister of said at least one silver recovery cell has an interior diameter; wherein further said anode rod of said at least one silver recovery cell is attached to said bottom at its geometrical center, said anode rod further being oriented axially relative to said clear canister; and further wherein said cathode cylinder of said at least one silver recovery cell has a diameter substantially equal to that of said interior diameter of said clear canister, said cathode cylinder extending coaxially with said anode rod.

15. The silver recovery system of claim 14, wherein said canister of said at least one silver recovery cell is constructed of a clear plastic.

16. The silver recovery system of claim 15, wherein said anode terminal of said at least one silver recovery cell is constructed of graphite; and wherein said cathode cylinder of said at least one silver recovery cell is made of stainless steel.

17. The silver recovery system of claim 16, further comprising more than one said silver recovery cell, each said silver recovery cell being mutually connected in series so that said silver laden solution flows through each said silver recovery cell serially.

18. Silver recovery cell for a silver recovery system, said silver recovery system being used for recovering silver from a silver laden solution, said silver recovery cell comprising:

a clear canister, said clear canister having a closed bottom and an open end;

an anode rod attached to said closed bottom of said clear canister, said anode rod projecting upwardly into said clear canister;

an anode terminal electrically connected to said anode rod;

a cathode cylinder in said clear canister, said cathode cylinder encircling without touching said anode rod, said cathode cylinder having a longitudinal slot;

a cathode terminal electrically connected to said cathode cylinder;

a top releasably attached to said clear canister at said open end;

inlet means for introducing said silver laden solution into said clear canister;

outlet means for exiting said silver laden solution from said clear canister;

means for fluidically sealing said top with respect to said clear canister; and a light connect to said top for illuminating said clear canister between said anode rod and said cathode cylinder.

19. A silver recovery cell for a silver recovery system, said silver recovery system being used for recovering silver from a silver laden solution, said silver recovery cell comprising:

a clear canister, said clear canister having a closed bottom and an open end;

an anode rod attached to said closed bottom of said clear canister, said anode rod projecting upwardly into said clear canister;

an anode terminal electrically connected to said anode rod;

a cathode cylinder in said clear canister, said cathode cylinder encircling without touching said anode rod, said cathode cylinder having a longitudinal slot;

a cathode terminal electrically connected to said cathode cylinder;

a top releasably attached to said clear canister at said open end;

inlet means for introducing said silver laden solution into said clear canister;

outliet means for exiting said silver laden solution from said clear canister;

means for fluidically sealing said top with respect to said clear canister; and an inlet port in fluidic communication with said inlet means, said inlet port being located in axial alignment with said anode rod, said inlet port causing flow of said silver laden solution to be sped up upon passage therethrough.

20. A silver recovery system, said silver recovery system being used for recovering silver from a silver laden solution, said silver recovery system comprising:

at least one silver recovery cell, each said silver recovery cell comprising:

a clear canister, said clear canister having a closed bottom and an open end;

an anode rod attached to said closed bottom of said clear canister, said anode rod projecting upwardly into said clear canister;

an anode terminal electrically connected to said anode rod;

a cathode cylinder in said clear canister, said cathode cylinder encircling said anode rod, said cathode cylinder having a longitudinal slot;

a cathode terminal electrically connected to said cathode cylinder;

a top releasably attached to said clear canister at said open end;

inlet means for introducing said silver laden solution into said clear canister;

outlet means for exiting said silver laden solution from said clear canister;

means for fluidically sealing said top with respect to said clear canister; and a light connected to said top for illumination said clear canister between said anode and said cathode cylinder;

electrical means for selectively supplying electricity to said anode terminal and said cathode terminal;

piping means for selectively piping said silver laden solution from a first location to said recovery cell and back to said first location; and pump means connected with said piping means for selectively pumping said silver laden solution from said first location to said inlet means of said recovery cell.

21. A silver recovery system, said silver recovery system being used for recovering silver from a silver laden solution, said silver recovery system comprising:

at least one silver recovery cell, each said silver recovery cell comprising:

a clear canister, said clear canister having a closed bottom and an open end;

an anode rod attached to said bottom of said clear canister, said anode rod projecting upwardly into said clear canister;

an anode terminal electrically connected to said anode rod;

a cathode cylinder in said clear canister, said cathode cylinder encircling said anode rod, said cathode cylinder having a longitudinal slot; a cathode terminal electrically connected to said cathode cylinder;

a top releasably attached to said clear canister at said open end;

inlet means for introducing said silver laden solution into said clear canister;

outlet means for exiting said silver laden solution from said clear canister;

means for fluidically sealing said top with respect to said clear canister; and an inlet port in fluidic communication with said inlet means, said inlet port being located in axial alignment with said anode rod, said inlet port causing flow of said silver laden solution to be sped up upon passage therethrough;

electrical means for selectively supplying electricity to said anode terminal and said cathode terminal;

piping means for selectively piping said silver laden solution from a first location to said recovery cell and back to said first location; and pump means connected with said piping means for selectively pumping said silver laden solution from said first locatin to said inlet means of said recovery cell.

* * * * *